US006499861B1

(12) United States Patent
German et al.

(10) Patent No.: US 6,499,861 B1
(45) Date of Patent: Dec. 31, 2002

(54) ILLUMINATED PATCH CORD CONNECTOR PORTS FOR USE IN A TELECOMMUNICATIONS PATCH CLOSET HAVING PATCH CORD TRACING CAPABILITIES

(75) Inventors: Michael Gregory German, Secaucus, NJ (US); Frank Salvatore Leone, Berkeley Heights, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/404,619

(22) Filed: Sep. 23, 1999

(51) Int. Cl.[7] ..... F21V 33/00
(52) U.S. Cl. ..... 362/253; 362/234
(58) Field of Search ..... 362/85, 24, 88, 362/240, 248, 253, 394, 800, 234; 361/633; 248/27.1; 439/490; 379/321, 330, 332

(56) References Cited

U.S. PATENT DOCUMENTS 3,052,842 A * 9/1962 Frohman et al. ..... 361/633
5,170,327 A * 12/1992 Burroughs ..... 361/633
5,550,755 A * 8/1996 Martin et al. ..... 340/825.44
6,078,113 A * 6/2000 True et al. ..... 439/490

* cited by examiner

*Primary Examiner*—Y. My Quach-Lee
(74) *Attorney, Agent, or Firm*—Woodbridge & Associates, P.C.; Richard C. Woodbridge

(57) ABSTRACT

A device, system and method for locating a specific patch cord connection port contained within a telecommunications closet having line tracing capabilities. An LED is provided at each of the connector ports present within the telecommunications closet that is positioned to illuminate the connector port or illuminate a shroud positioned in front of the connector port. The LEDs can be individually and selectively illuminated. Accordingly, individually identified connector ports can be selectively illuminated within the telecommunications closet. This greatly increases the ability of a technician to accurately locate the patch cord connector port within the telecommunications closet that has been targeted by the patch cord tracing system.

9 Claims, 4 Drawing Sheets

ILLUMINATED PATCH CORD CONNECTOR PORTS FOR USE IN A TELECOMMUNICATIONS PATCH CLOSET HAVING PATCH CORD TRACING CAPABILITIES

RELATED APPLICATIONS

This application is related to the following co-pending applications, the disclosures of which are incorporated into this specification by reference.

U.S. patent application Ser. No. 09/247,614, entitled SYSTEM AND METHOD OF OPERATION FOR A TELECOMMUNICATIONS PATCH SYSTEM;

U.S. patent application Ser. No. 09/247,269, entitled TRACING INTERFACE MODULE FOR PATCH CORDS IN A TELECOMMUNICATIONS PATCH SYSTEM;

U.S. patent application Ser. No. 09/247,385, entitled DISPLAY PANEL OVERLAY STRUCTURE AND METHOD FOR TRACING INTERFACE MODULES IN A TELECOMMUNICATIONS PATCH SYSTEM;

U.S. patent application Ser. No. 09/247,270, entitled METHOD AND DEVICE FOR DETECTING THE PRESENCE OF A PATCH CORD CONNECTOR IN A TELECOMMUNICATIONS PATCH SYSTEM;

U.S. patent application Ser. No. 09/247,237, entitled METHOD AND DEVICE FOR DETECTING THE PRESENCE OF A PATCH CORD CONNECTOR IN A TELECOMMUNICATIONS PATCH SYSTEM USING PASSIVE DETECTION SENSORS;

U.S. patent applicaton Ser. No. 09/404,420, entitled SYSTEM AND METHOD FOR IDENTIFYING SPECIFIC PATH CORD CONNECTORS IN A TELECOMMUNICATIONS PATCH SYSTEM.

BACKGROUND OF THE INVENTION

1. Field of the Invention

The present invention relates to the structure and method of operations of dedicated telecommunications patching systems where telecommunications lines are selectively coupled to one another in a telecommunications closet using patch cords. More particularly, the present invention relates to telecommunication patching systems that embody patch cord tracing capabilities that help a technician locate the opposite ends of a specific patch cord within the system.

2. Description of the Prior Art

Many businesses have dedicated telecommunication systems that enable computers, telephones, facsimile machines and the like to communicate with each other, through a private network, and with remote locations via a telecommunications service provider. In most buildings, the dedicated telecommunications system is hard wired using telecommunication cables that contain conductive wire. In such hard wired systems, dedicated wires are coupled to individual service ports throughout the building. The wires from the dedicated service ports extend through the walls of the building to a telecommunications closet or closets. The telecommunications lines from the interface hub of a main frame computer and the telecommunication lines from external telecommunication service providers are also terminated within the telecommunications closets.

A patching system is used to interconnect the various telecommunication lines within the telecommunications closet. In a telecommunications patching system, all of the telecommunication lines are terminated within the telecommunications closet in an organized manner. The organized terminations of the various lines are provided via the structure of the telecommunications closet. Within the telecommunications closet is typically located a mounting frame. On the mounting frame is connected a plurality of racks. The telecommunications lines terminate on the racks, as is explained below.

Referring to FIG. 1, a typical prior art rack 10 is shown. The rack 10 retains a plurality of patch panels 12 that are mounted to the rack 10. On each of the patch panels 12 are located port assemblies 14. The port assemblies 14 each contain six telecommunication connector ports 16 which can accommodate connectors such as the RJ-45.

Each of the different telecommunication connector ports 16 is hard wired to one of the system's telecommunications lines. Accordingly, each telecommunications line is terminated on a patch panel 12 in an organized manner. In small patch systems, all telecommunications lines may terminate on the patch panels of the same rack. In larger patch systems, multiple racks are used, wherein different telecommunications lines terminate on different racks.

In the shown embodiment of FIG. 1, the interconnections between the various telecommunications lines are made using patch cords 20. Both ends of each patch cord 20 are terminated with connectors 22, such as an RJ-45 telecommunication connector or a RJ-11 telecommunications connector. One end of the patch cord 20 is connected to the connector port 16 of a first telecommunications line and the opposite end of the cord is connected to the connector port 16 of a second telecommunications line. By selectively connecting the external lines to the internal lines with the patch cords 20, any combination of telecommunications lines can be interconnected.

In many businesses, employees are assigned their own computer network access number exchange so that the employee can interface with the company's main frame computer or computer network. When an employee moves offices, it is not desirable to provide that employee with newly addressed telecommunication connection ports. Rather, to preserve consistency in communications, it is preferred that the voice and data services being provided to connection ports in the employee's old office be transferred to the telecommunications ports in the employee's new office. To accomplish this task, the patch cords in the telecommunication closet are rearranged so that the employee's old voice and data services are now received in his/her new office.

As employees, move, change positions, add lines and subtract lines, the patch cords in a typical telecommunications closet are rearranged quite often. The interconnections of the various patch cords in a telecommunications closet are often logged in either paper or computer based log. However, technicians often neglect to update the log each and every time a change is made. Inevitably, the log is less than 100% accurate and a technician has no way of reading where each of the patch cords begins and ends. Accordingly, each time a technician needs to change a patch cord, that technician manually traces that patch cord between an internal line and an external line. To preform a manual trace, the technician locates one end of a patch cord. The technician then manually follows the patch cord until he/she finds the opposite end of that patch cord. Once the two ends of the patch cord are located, the patch cord can be positively identified.

It takes a significant amount of time for a technician to manually trace a particular patch cord. Furthermore, manual tracing is not completely accurate and technicians often accidently go from one patch cord to another during a manual trace. Such errors result in misconnected telecommunication lines which must be later identified and corrected.

Additionally, when repositioning a patch cord, it is often difficult for a technician to find a specific connector port in the hundreds of connector ports available in a telecommunications closet. Accordingly, it is not uncommon for a technician to accidently select the wrong connector port and disrupt a patch cord connection that should not have been disrupted.

In an attempt to assist a technician in finding a specific connector port within a telecommunications closet, tracing systems have been developed that provide a visible indication as to the location of a targeted connector port. Such tracing systems are exemplified in co-pending application Ser. No. 09/247,614, entitled System and Method of Operation For a Telecommunication Patch System, which is incorporated into this disclosure by reference. In such systems, a light is lit next to the connector port being targeted. A technician can see the light and is immediately led to the targeted connector port. The light is an LED that is positioned near each of the connector ports. The LEDs are built into the structure of the racks that support the connector ports.

A problem associated with such tracing systems that use LEDs is that the LEDs are small and are densely packed together on the different racks in the telecommunications closet. Accordingly, it is not uncommon for a technician to experience parallax and associate a particular LED with the wrong connector port. This often results in the technician disrupting the wrong patch cord connection in the telecommunications closet.

A need therefore exists for an apparatus and method that better identifies a specific patch cord connector ports within the confines of a telecommunications closet.

SUMMARY OF THE INVENTION

The present invention is a device, system and method for locating a specific patch cord connection port contained within a telecommunications closet having line tracing capabilities. An LED is provided at each of the connector ports present within the telecommunications closet that is in position to illuminate the connector port or illuminate a shroud positioned in front of the connector port. The LEDs can be individually and selectively illuminated. Accordingly, individually identified connector ports can be selectively illuminated within the telecommunications closet. This greatly increases the ability of a technician to accurately locate the patch cord connector port within the telecommunications closet that has been targeted by the patch cord tracing system.

BRIEF DESCRIPTION OF THE DRAWINGS

For a better understanding of the present invention, reference is made to the following description of and exemplary embodiment thereof, considered in conjunction with the accompanying drawings, in which.

DETAILED DESCRIPTION OF THE DRAWINGS

Figure 1:
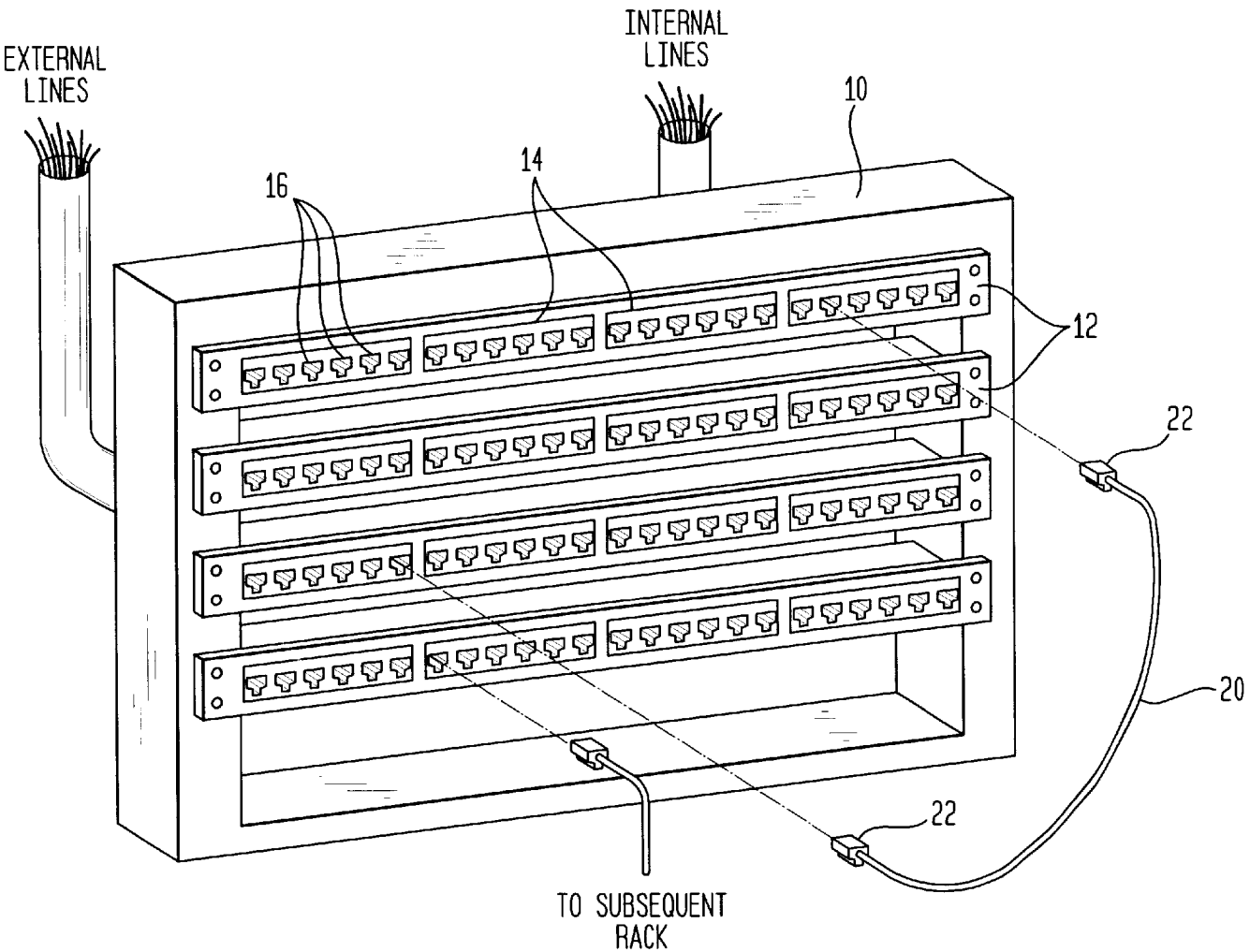
FIG. 1 (PRIOR ART)
FIG. 1 is a perspective view of a typical prior art telecommunications rack assembly containing multiple patch panels with connector ports that are selectively interconnected by patch cords.
Figure 2:
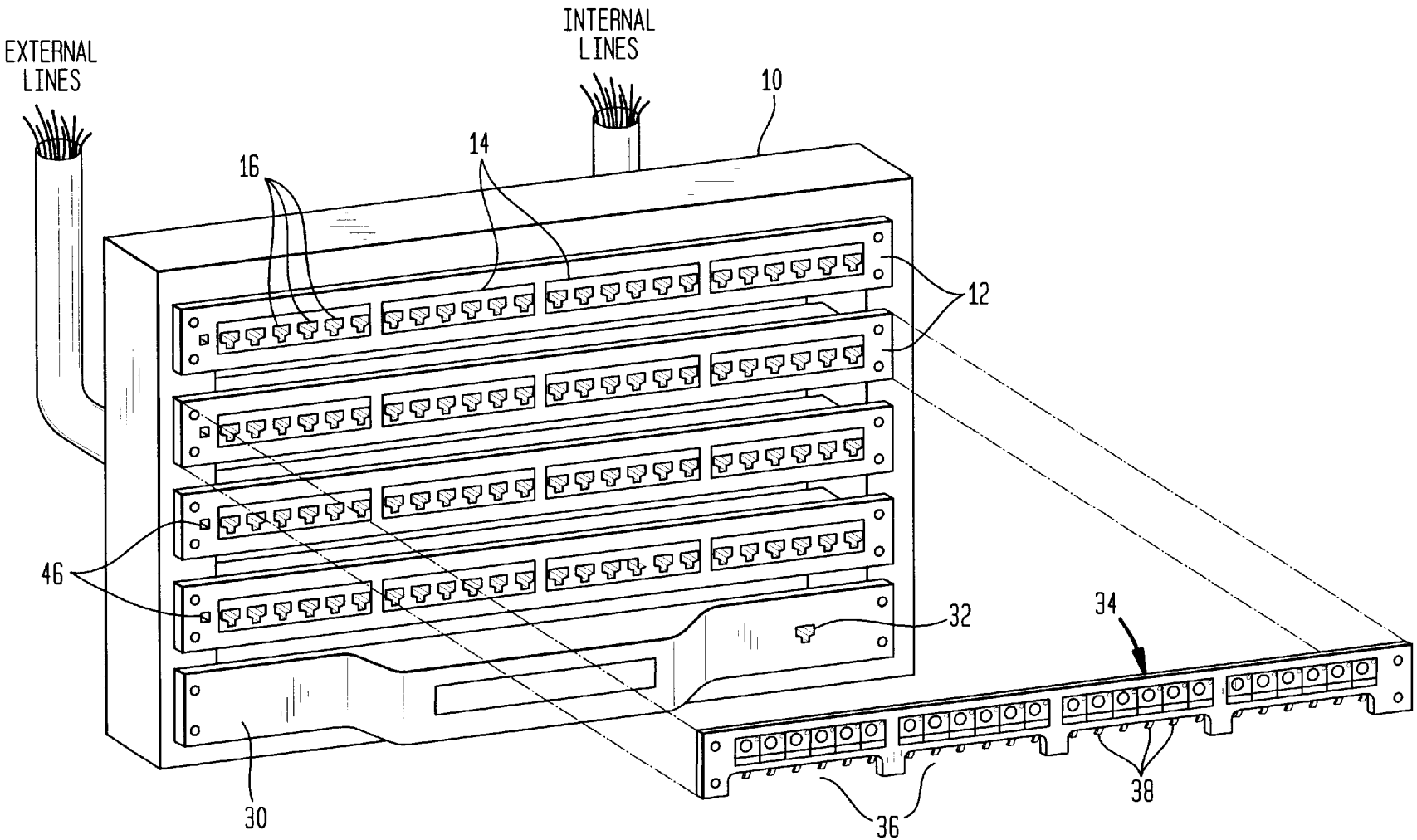
FIG. 2 is a perspective view of a tracing interface module and rack controller in accordance with the present invention, shown in conjunction with the prior art telecommunications rack assembly of FIG. 1.

Referring to FIG. 2, a conventional telecommunications rack 10 is shown, such as the one previously described in regard to FIG. 1. The telecommunications rack 10 contains a plurality of patch panels 12 that are mounted in parallel horizontal rows within the rack 10. Each of the patch panels 12 contain a plurality of port assemblies 14. The connector ports 16 associated with each of the port assemblies 14 are hard wired to the incoming external lines or the incoming internal lines.

In the present invention system, a rack controller 30 is mounted to each rack 10 in the overall patch system. The rack controller 30 contains a central processing unit (CPU). If multiple racks are present within the telecommunications closet, the rack controllers on different racks are interconnected with one another so that they can communicate in a common network as if they were a single controller. The CPU is capable of independently running line tracing programs and also contains a remote access port 32 that enables the CPU to be accessed by a remote computer. Remote access of the rack controller is the subject of related co-pending patent application Ser. No. 09/247,614, entitled System And Method Of Operation For A Telecommunications Patch System, which has already been incorporated into this application by reference.

The purpose of the rack controller 30 is to operate and gather data from the various tracing interface modules 34, as will be later explained. The tracing interface modules 34 are modules that mount to the face of each patch panel 12 on the rack 10. The tracing interface modules 34 surround the various connector ports 16 located on patch panels 12 and provide an interface through which data about each connector port 16 can be transmitted to and from the rack controller 30.

The tracing interface module 34 can have multiple different configurations. The structure and different configurations of the tracing modules are disclosed in related co-pending patent application Ser. No. 09/247,269, entitled Tracing Interface Module For Patch Cords In A Telecommunications Patch System; patent application Ser. No. 09/247,385, entitled Display Panel Overlay Structure And Method For Tracing Interface Modules In A Telecommunications System; and patent application Ser. No. 09/247,270, entitled Method And Device For Detecting The Presence Of A Patch Cord Connector In A Telecommunications Patch System. These applications have already been incorporated into this application by reference.

In the shown embodiment, the tracing interface module 34 contains a rectangular relief 36 that surrounds the connector ports 16 on each port assembly 14 when the tracing interface module 34 is connected to the patch panels 12. Referring to FIG. 2, in conjunction with FIG. 3, it can be seen that extending into each rectangular relief 36 is a plurality of sensors 38. Each sensor 38 corresponds in position with one of the connector ports 16 on the patch panel 12. As the terminated end of a patch cord 20 (FIG. 1) is connected to a connector port 16, the presence of the patch cord is detected by the rack controller 30. The rack controller 30 is therefore capable of automatically determining when a patch cord has been added or removed from any connector port 16 on the rack 10.

Figure 3:
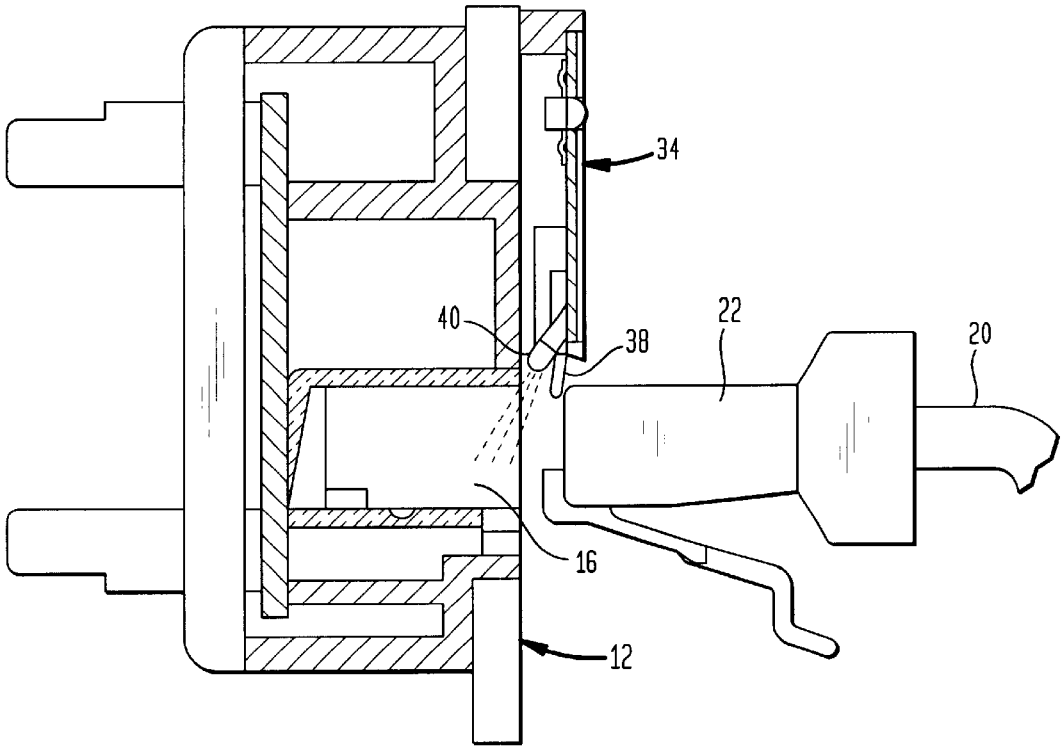
FIG. 3 is a cross sectional view of a section of the tracing interface module in FIG. 2, attached to a prior art patch panel.

Referring to FIG. 3, it can be seen that in addition to the sensors 38, the tracing interface module 34 also contains light emitting diodes (LEDs) 40 that are positioned next to each of the sensors 38. An LED 40 is therefore provided for each connector port 16 when the tracing interface module 34 is connected to the patch panel 12. The LED 40 is positioned so that it illuminates the patch cord connector port 16 when lit. Accordingly, once the tracing interface module 34 is in place, each connector port 16 on the patch panel 12 has an LED 40 suspended just above that connector port 16 that is capable of illuminating that connector port 16.

When a specific LED 40 is lit, the connector port 16 associated with that LED 40 is illuminated. That port therefore becomes immediately identifiable on the racks of the telecommunications closet. This greatly increases the ability of a technician to accurately locate a targeted connector port 16 within the patch cord administration system.

Figure 4:
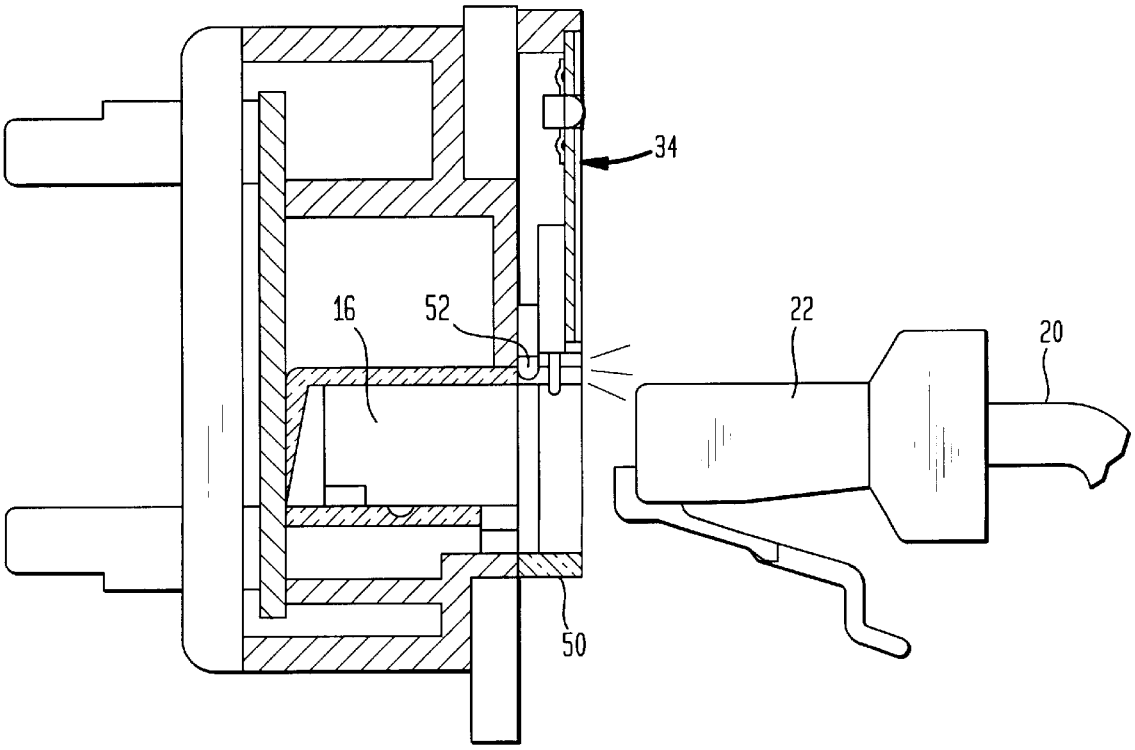
FIG. 4 is a cross sectional view of a an alternate embodiment of a tracing interface module attached to a prior art patch panel.

Referring to FIG. 4, an alternate embodiment of the present invention system is shown. In this embodiment, a translucent shroud 50 extends from below the tracing interface module 34 in front of each connector port 16. The translucent shroud 50 is a tubular element that encircles the open face of each of the patch cord connector ports 16. Accordingly, when a patch cord connector 22 is inserted into a connector port 16, the patch cord connector 22 must first pass through the translucent shroud 50.

An LED 52 is positioned above each translucent shroud 50, within the tracing interface module 34. When the LED 52 is lit, the light from the LED 52 passes into the material of the translucent shroud 50. Since the shroud 50 is translucent, the light from the LED 52 enters the shroud 50 and reflects around interior surfaces of the shroud 50. Should light from the LED 52 strike an interior surface of the shroud 50 at an angle greater than the inherent angle of reflection of the shroud material, the light exits the shroud 50. The result is a shroud 50 that is internally illuminated by the LED 52 throughout its structure. Accordingly, since the shroud 50 completely surrounds the open face of the connector port 16, the area immediately surrounding the connector port 16 is illuminated. The illuminated shroud 50 surrounding the connection port 16 provides a positive target for a technician that can not be mistaken by parallax or some other optical illusion. Consequently, the illuminated translucent shroud 50 greatly increases the likelihood that a technician will correctly service the proper connector port 16 selected by the line tracing subroutines utilized in the telecommunications closet.

The embodiments shown in FIG. 3 and FIG. 4 can be retroactively added to existing telecommunication closets. However, for newly manufactured assemblies, the technology of an illuminated connector port can be designed directly into the structure of the various port assemblies.

Figure 5:
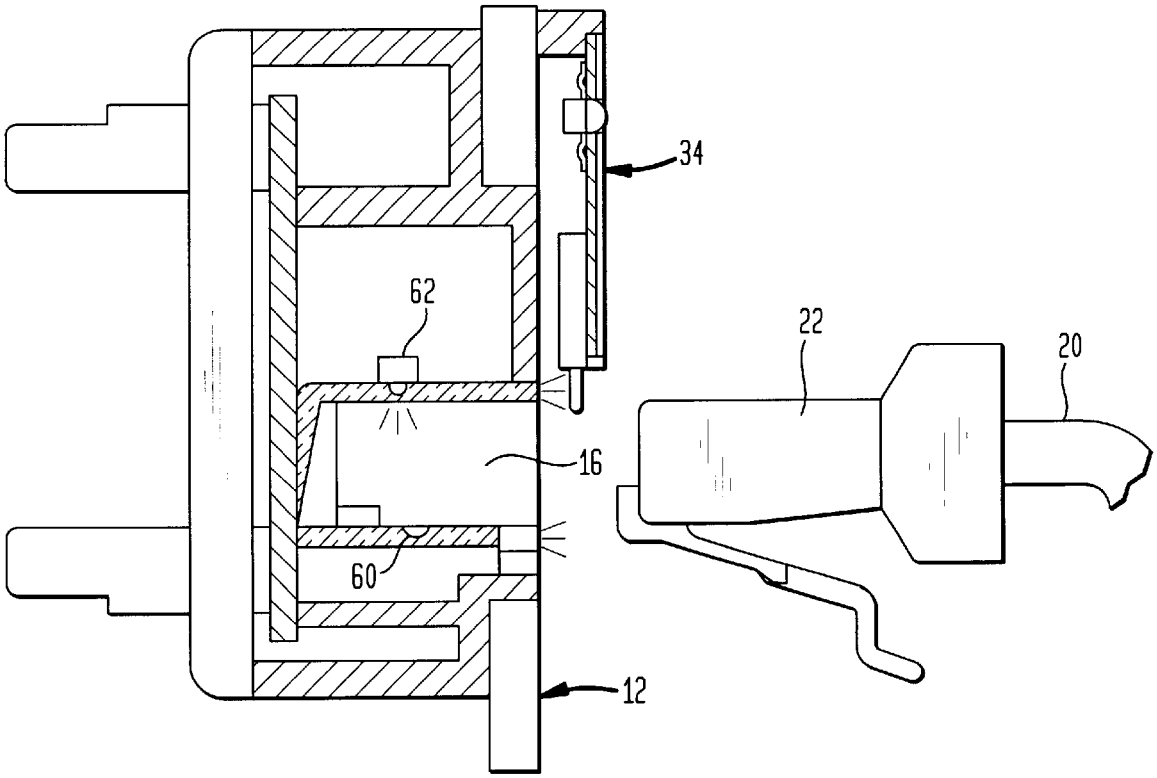
FIG. 5 is a cross sectional view of a patch panel in accordance with the present invention.

Referring to FIG. 5, yet another embodiment of the present invention system is shown. In this embodiment, the casing 60 of the connector port 16 itself is made of a translucent material. An LED 62 is contained within the structure of each port assembly 12. When the LED 62 is lit, the light from the LED 62 passes into the material of the connector port casing 60. Since the connector port casing 60 is translucent, the light from the LED 62 enters the casing 60 and reflects around interior surfaces of the casing 60. Should light from the LED 62 strike an interior surface of the connector port casing 60 at an angle greater than the inherent angle of reflection of the casing material, the light exits the casing 60 and illuminates the connector port 16 defined by that casing 60. The result is a connector port casing 60 that is internally illuminated by the LED 62 throughout its structure. Accordingly, since the connector port casing 60 completely surrounds the connector port 16, the interior of the connector port 16 is illuminated. The illuminated connector port 16 therefore provides a positive target for a technician that can not be mistaken by parallax or some other optical illusion. Consequently, the illuminated connector port 16 greatly increases the likelihood that a technician will correctly service the proper connector port 16 selected by the line tracing subroutines utilized in the telecommunications closet.

It will be understood that the embodiment of the present invention specifically shown and described is merely exemplary and that a person skilled in the art can make alternate embodiments using different configurations and functionally equivalent components. For example, there can be many different configuration for the connector ports and the position of illuminating LEDs for those connector ports. All such alternate embodiments are intended to be included in the scope of this invention as set forth in the following claims.

What is claimed is:

1. An improved patch cord connector port assembly for use in a telecommunications closet, comprising:

a casing that defines a patch cord connector port, wherein said casing has an open face surface adapted to receive a patch cord connector therethrough, wherein said casing is translucent; and an LED positioned proximate said casing so as to transmit light into said casing, thereby illuminating said casing.

2. The assembly according to claim 1, wherein light from said LED passes into said casing and internally illuminates said casing.

3. In a telecommunications closet containing a plurality of patch cord connector ports disposed on at least one rack, an illumination device for selectively illuminating each of said connector ports, comprising:

a module mountable to each rack, wherein each module contains LEDs that are directed to the connector ports on a rack when said module is mounted to said rack, wherein light from each said LED selectively illuminates one of the connector ports when lit and wherein said module further includes a plurality of shrouds that extend from said module, wherein each of said shrouds is disposed in front of each of the connector ports, whereby any patch cord connector entering a connector port must first pass through one of said shrouds.

4. The device according to claim 3, wherein each of said shrouds is tubular in structure, having two open ends, and is symmetrically around a common center axis that aligns with each of the connector ports.

5. The device according to claim 3, wherein each of said shrouds is translucent.

6. The device according to claim 5, wherein said LEDs illuminate said shrouds.

7. In a telecommunications closet having numerous connector ports, patch cords interconnecting connector ports, and a patch cord administration system, a method of locating a specific connector port in the patch cord administration system, comprising the steps of:

providing an LED proximate each of the connector ports translucent casings of the in the telecommunications closet; and selectively illuminating the translucent casings of any of said connector ports identified by the patch cord administration system.

8. The method according to claim 7, wherein said step of providing an LED proximate each of the connector ports includes placing an LED within each of the translucent casings.

9. The method according to claim 7, wherein said LED is disposed within the translucent casing and internally illuminates the translucent casing.

* * * * *